United States Patent [19]

Kline

[11] Patent Number: 4,634,122

[45] Date of Patent: Jan. 6, 1987

[54] HOLDER FOR FOOTBALL PLACE-KICKING PRACTICE

[76] Inventor: Roy A. Kline, 8311 Park State Dr., Fort Wayne, Ind. 46815

[21] Appl. No.: 756,762

[22] Filed: Jul. 18, 1985

[51] Int. Cl.[4] ..... A63B 67/00

[52] U.S. Cl. ..... 273/55 B

[58] Field of Search ..... 273/55 B

[56] References Cited

U.S. PATENT DOCUMENTS

| | | | |
|---|---|---|---|
| D. 235,462 | 6/1975 | Pennington | 273/55 B |
| 3,105,686 | 10/1963 | Elsea | 273/55 B |
| 3,762,706 | 10/1973 | Cavett | 273/55 B |
| 3,897,948 | 8/1975 | Gerela | 273/55 B |
| 4,049,267 | 9/1977 | Forrest | 273/55 B |
| 4,477,077 | 10/1984 | Ferrebee | 273/55 B |
| 4,546,974 | 10/1985 | Brown | 273/55 B |

*Primary Examiner*—Richard C. Pinkham
*Assistant Examiner*—T. Brown
*Attorney, Agent, or Firm*—Jeffers, Irish & Hoffman

[57] ABSTRACT

A football place-kicking practice holder has a base adapted to rest on a playing surface and support a football at its lower end when in a teed up position, an elongated rigid support member attached to the base and mounted in an upright position on the base such that it is spaced from one side of the football, and an elongated rigid arm being pivotally mounted to the support member for movement through an arcuate path downwardly toward, and upwardly away from, the football and in a direction extending generally transverse to the general direction of flight of the football when kicked from the teed up position. An outer end of the arm has a threaded section which is located between the support member and the football when the arm has been moved downwardly toward the football and a flexible hollow finger inserted on the outer end of the arm is disposed into contact with an upper end of the football for maintaining it in the teed up position. A weighted body is threaded on the threaded section of the arm and movable therealong by rotation for adjusting the tension imposed on the teed up football by the finger.

27 Claims, 8 Drawing Figures

HOLDER FOR FOOTBALL PLACE-KICKING PRACTICE

BACKGROUND OF THE INVENTION

1. Field of the Invention

The present invention generally relates to athletic practice devices and, more particularly, is concerned with a holder for practicing football place-kicking without the assistance of another person.

2. Description of the Prior Art

Over the past several decades, accurate place-kicking capability for scoring field goals as well as extra points has become an indispensable weapon in the arsenal of the modern football team. The place-kick is typically performed with a player called a holder assisting the kicker by teeing up the football in a stationary upright position with its one tip end resting on the playing surface or a flat kicking plate commonly referred to as a tee. The ball is hiked from the center to the holder who transfers it to the teed up position just a second or so before the kicker's foot engages the ball. The holder normally steadies the ball in the desired upright position by placing his index finger on the upper tip end of the ball and applying a slight pressure downwardly on the ball.

High proficiency in accurate place-kicking is attained by hours and hours of practice out of season as well as during season. To most nearly simulate actual game conditions, the participation of a center and holder, or at least a holder, would be required at practice sessions. However, it is impractical, except possibly at the professional level, to dedicate the services of one player solely to serving as the practice holder for the place-kicker. Thus, during the past several decades, a variety of mechanical practice devices have been employed as a substitute for the human holder.

Representative of the prior art are the football place-kicking practice devices disclosed in U.S. Pat. Nos. (Des. 235,462) to Pennington, Elsea (3,105,686), Cavett (3,762,706), Gerela (3,897,948), Forrest (4,049,267) and Ferrebee (4,477,077). While many practice devices of the prior art would appear to operate reasonably well and generally achieve their objectives under the range of operating conditions for which they were designed, most seem to embody shortcomings which make them less than an optimum practice device. Some practice devices have rigid parts which are likely to be contacted by the kicker's foot and may result in injury to it. Other devices fail to provide a way to adjust the tension or force imposed on the football so that it can be maintained in a desired position for place-kicking practice under different weather conditions. Still others which provide for variation of the tension applied on the football require the adjustment of a complicated mechanism or the use of tools and take too much time to perform the adjustment steps.

Consequently, a need still exists for a football place-kicking practice device which is easy to set up and use, relatively simple in construction and operation, accurately simulates actual game conditions, minimizes the possibility of the kicking foot contacting rigid parts, and is readily adjustable to facilitate place-kicking practice under different weather conditions.

SUMMARY OF THE INVENTION

The present invention provides a football place-kicking practice holder designed to satisfy the aforementioned needs. The place-kicking practice holder of the present invention incorporates several features which cooperate to simulate place-kicking under actual playing conditions to the maximum extent possible. These features which simulate the arm and holding finger(s) of the human holder relate to a pivotal arm having a finger in the form of a flexible tube and tension-adjustable means in the form of a weighted body mounted for movement along the arm. The position of the weighted body along the arm is infinitely variable for allowing the finger to be preset to impose an amount of tension on the football tailored to the prevailing weather conditions. Then, when the football is kicked, the configuration of the arm in conjunction with the weighted body ensure that the arm will pivot quickly out of the way so as not to obstruct the follow-through motion of the kicking foot. Overall, the holder is constructed from standard materials and parts relatively easy to obtain, fabricate and assemble together. In essence, a hallmark of the practice-kicking holder of the present invention is the simplicity which underlies its construction, set up and operation.

Accordingly, the present invention is directed to a football place-kicking practice holder, comprising: (a) a base adapted to rest on a playing surface and generally define a location for placing a football in a teed up position; (b) a support member mounted in an upright position on the base such that the member is spaced from a side of the football when the football is disposed in the teed up position; (c) an elongated arm being pivotally mounted to the support member for movement downwardly toward, and upwardly away from, the football in the teed up position and about an axis extending along the general direction of the flight of the football when kicked from the teed up position; (d) a flexible finger connected to the arm and disposable into contact with an upper end of the football for maintaining it in the teed up position when the arm is moved relative to the support member downwardly toward the football after the football has been placed in the teed up position; and (e) means disposed on the arm for movement therealong between the football and the support member to adjust the tension imposed on the teed up football by the finger.

More particularly, the support member can have a generally straight configuration or a generally bowed configuration which respectively allow sufficient space between the member and the football being maintained in the teed up position by the finger for accommodating the follow-through motion of the kicking foot of a straight-style place-kicker or a soccer-style place-kicker past the support member. Also, the elongated arm has a threaded section which is located between the support member and the football when the arm has been moved downwardly toward the football and the finger has been brought into contact with the football so as to maintain it in the teed up position. The tension-adjusting means is a weighted body threaded on the section of the arm for movement therealong by rotation of the body. The rotation of the body in one direction produces movement of the body toward the support member which decreases the tension applied by the finger on the football, whereas rotation of the weighted body in an opposite direction produces movement of the body toward the football which increases the tension applied by the finger on the football.

Furthermore, the base and support member include cooperable means for releasably connecting the support member to the base such that the position of the support member can be adjusted on the base along the general direction of flight of the football and thereby the position of the arm and finger can be adjusted relative to the football for varying the angle of the football in the teed up position. Also, the base includes means for mounting a kicking tee so as to define the location on the base for placing the football in the teed up position.

Additionally, because of the general position of the weighted body on the arm in combination with the configuration of the arm, the arm of the holder is movable quickly, upon the football being kicked from the teed up position, from a football holding position to either of two possible inoperative rest positions. The arm and finger in one of the rest positions assume a generally lowered inclination due to the force of gravity and due to the football being kicked without the kicking foot contacting the finger. In the other of the rest positions, the arm and finger assume a raised inclination upon their displacement by the force of the kicking foot due to the foot contacting the finger.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
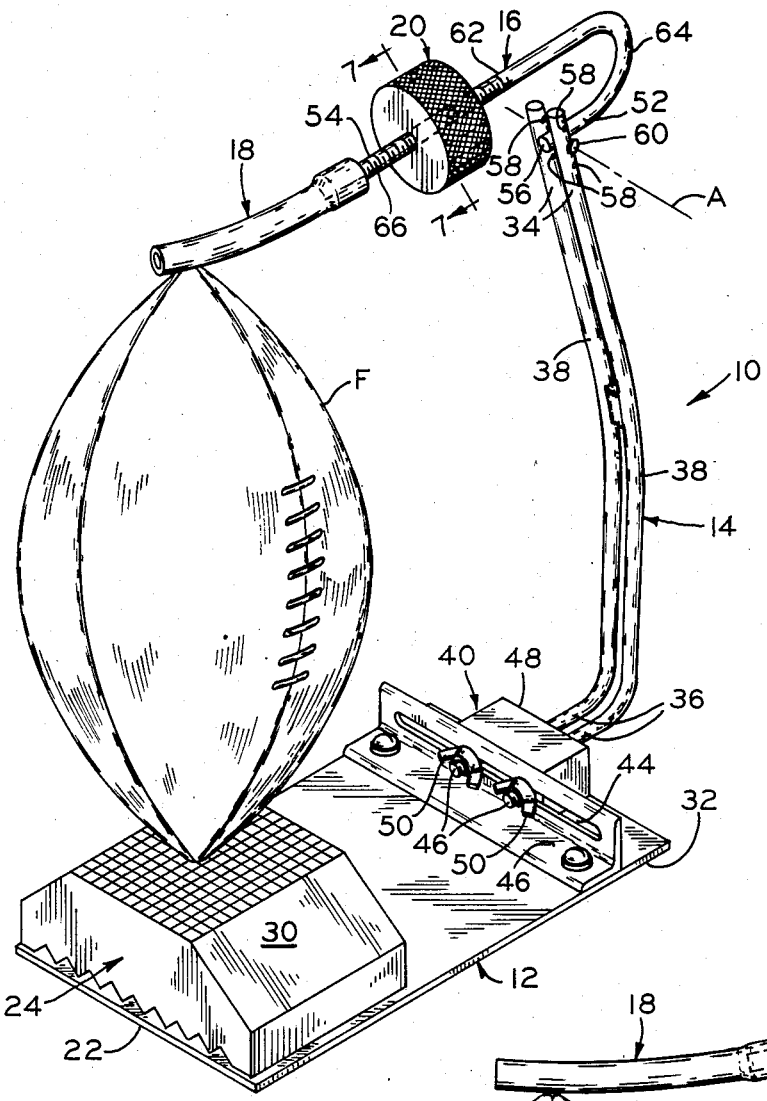
FIG. 1 is a perspective view of the preferred embodiment of a football place-kicking practice holder employing the improved features of the present invention.
Figure 2:
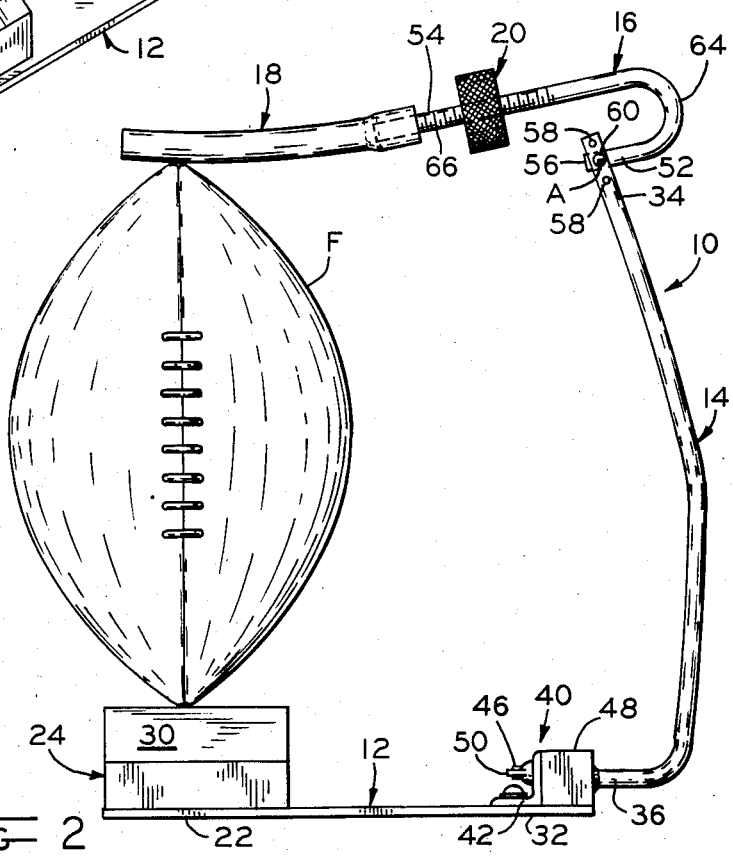
FIG. 2 is a side elevational view of the place-kicking practice holder of FIG. 1, showing a pivotal arm and flexible finger of the holder extending in a holding position in which a football is maintained on a kicking tee of the holder in a desired teed up position for kicking practice.
Figure 7:
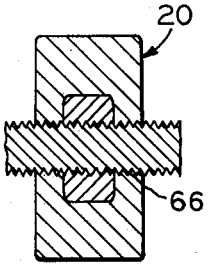
FIG. 7 is an enlarged sectional view of the weighted body disposed on a threaded section of the arm of the holder as taken along line 7—7 of FIG. 1.
Figure 3:
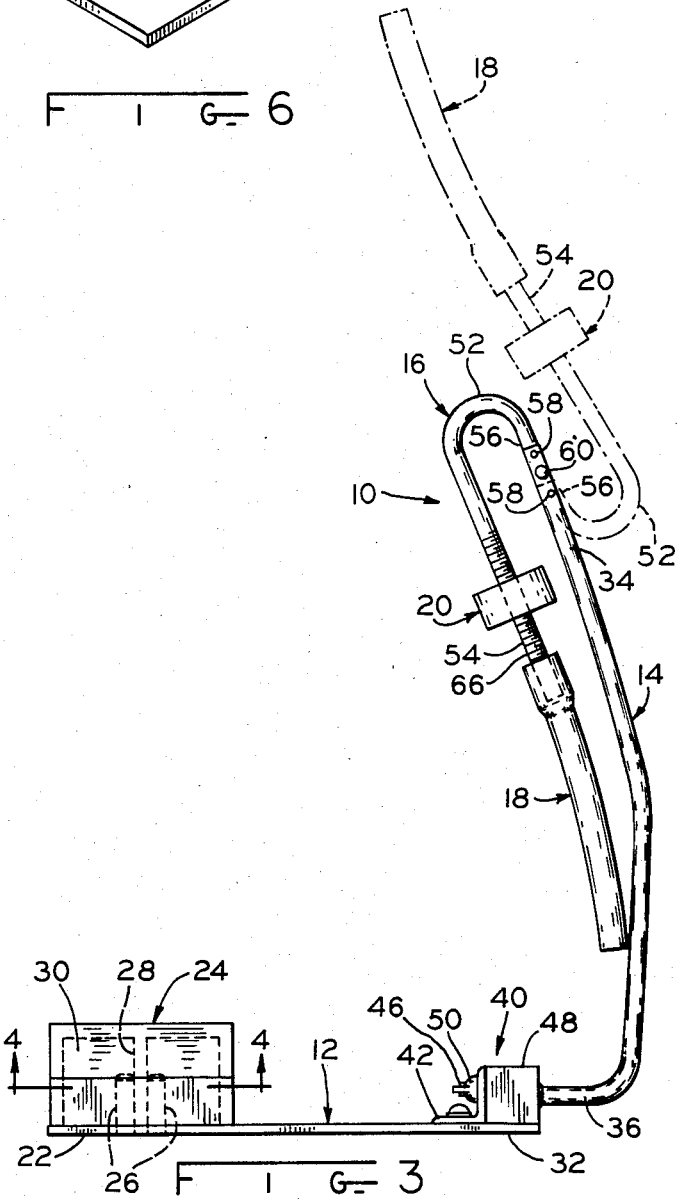
FIG. 3 is a side elevational view of the holder similar to that of FIG. 2, but showing in solid line form one possible inoperative rest position assumed by the arm and finger due to the force of gravity when the football is kicked without the kicking foot contacting the finger, while showing in dashed line form the other possible inoperative rest position to which the arm and finger are displaced by the force of the kicking foot on an occasion when foot happens to contact finger.

Referring now to the drawings, and particularly to FIGS. 1 to 3, there is shown a football place-kicking practice holder, generally designated by the numeral 10 and constituting the preferred embodiment of the present invention. In its basic components, the holder 10 includes a base 12, a support member 14, and elongated arm 16, a flexible finger 18 and a tension adjustment means 20.

Figure 4:
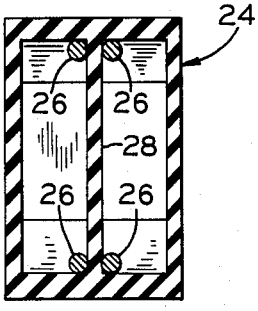
FIG. 4 is a sectional view of a kicking tee on the holder as taken along line 4—4 of FIG. 3, showing the interior structure of the tee and a plurality of tee locating pins on the base of the holder for releasably retaining the tee in the desired position on the holder base.
Figure 5:
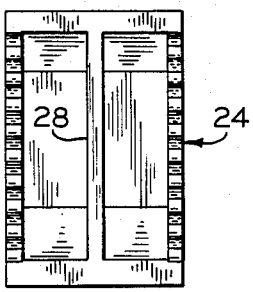
FIG. 5 is a bottom plan view of the kicking tee removed from the base of the holder of FIG. 3.
Figure 6:
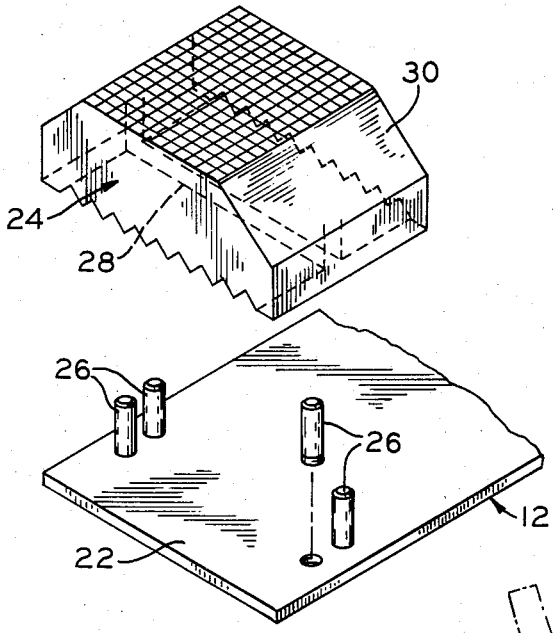
FIG. 6 is an exploded fragmentary perspective view of the holder of FIG. 1, only showing one lateral end of the holder base with the kicking tee aligned and spaced above the tee locating and retaining pins on the base.

The holder base 12 is in the form of a flat plate or platform adapted to rest on a playing surface and to generally define a location for placing a football in a teed up position. Preferably, the base 12 is provided with an extended lateral end 22 for defining the location on the base, as opposed to on the playing surface, at which a standard kicking tee 24 for college, high school and middle school can be used for placing the football F in the teed up position, such as seen in FIGS. 1 and 2. In some instances, it may be desirable to provide means to more positively retain the kicking tee 24 on the holder base 12. Such means can take the form of a plurality of pins 26 removably threaded into the flat base 12 and arranged in two spaced pairs for receiving therebetween an interior central wall 28 of the kicking tee 24, such as seen in FIGS. 3, 4 and 6. In such manner, the tee 24 is releasable retained on the base 12 at its lateral end 22. Thus, in those instances where the foot of the kicker concurrently engages the beveled edge 30 of the tee 24 along with the football F, the tee will release with the football just as would happen if the tee was supported on the playing surface.

The support member 14 of the place-kicking practice holder 10 is mounted in a generally upright position on another lateral end 32 of the base being opposite to the one lateral end 22. In such location, the support member 14 is spaced from the football F when the football is disposed in its teed up position on the kicking tee 24, as seen in FIGS. 1 and 2. Generally, the support member 14 has opposite upper and lower ends 34, 36 with the member being interconnected at its lower end 36 to, and mounted in an upright position upon, the base 12. In an illustrative embodiment, the support member 14 is formed by a pair of bars 38 being arranged in generally side-by-side fashion and connected together so as to define a space therebetween at each of the upper and lower ends 34, 36.

Provided on the base 12 along its lateral end 32 and on the support member 14 at its lower end 36 is cooperable means, generally indicated at 40, for releasably connecting the support member lower end to the base. The cooperable means 40 includes a bracket 42 fixed on the base and having an elongated slot 44 defined therein which extends in the general direction of flight of the football F when kicked from the holder 10. Also, a pair of fasteners 46 fitted through a block 48 on lower end 36 of support member 14 are extendible through the bracket slot 44 and by use of a pair of wing nuts 50 can be tightened to the bracket 42 for releasably connecting the support member 14 at any desired position along the bracket. Parenthetically, the block 48 is fixed to the lower spaced ends of the two bars 38 composing the support member 14.

By such arrangement of the cooperable means 40, it is readily seen that the position of the support member 14 can be adjusted on the base 12 along the general direction of flight of the football when kicked from the teed up position. As will become clear below, through such adjustment of the position of the support member 14 the positions of the arm 16 and the flexible finger 18 relative to the football F can be adjusted for varying the angle of the football in the teed up position.

Figure 8:
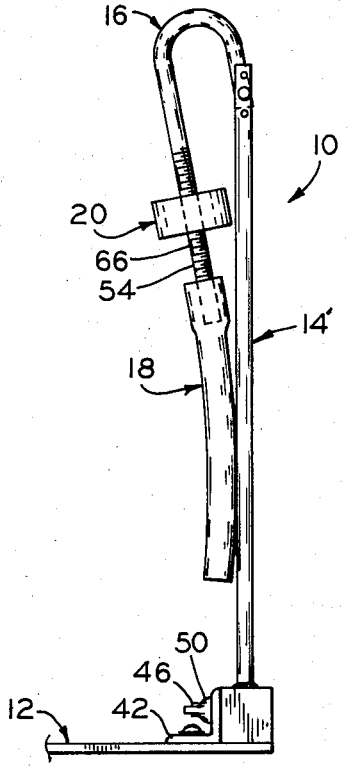
FIG. 8 is a side elevational view of an alternative embodiment of the holder which is generally similar to the referred embodiment of FIGS. 1 to 3 with the exception that the alternative embodiment accommodates solely straight-style place-kicking whereas the preferred embodiment will accommodate both straight-style and soccer-style place-kicking.

As can be realized from a comparison of FIGS. 3 and 8, the support member 14 can have either one of two configurations. The preferred configuration is the one in which the support member 14 is bowed in a direction away from the football F as shown in FIG. 3. Such configuration allows sufficient space between the support member 14 and the football F in the teed up position for accommodating the follow-through motion of the kicking foot of a soccer-style or straight-style place-kicker past the support member. On the other hand, the generally straight configuration of the support member 14 in FIG. 8 allows sufficient space between the member and the football for only accommodating the follow-through motion of the kicking foot of the straight-style place-kicker past the support member.

The elongated arm 16 of the practice holder 10 has inner and outer ends 52, 54. At its inner end 52, the arm 16 is pivotally mounted to the upper end 34 of the support member 14 for movement downwardly toward, and upwardly away from, the football F in the teed up position and in a direction extending generally transverse to the general direction of flight of the football when kicked from its teed up position. Specifically, the spaced upper ends of the bars 38 composing the support member 14 receive a tip 56 of the inner arm end 52 therebetween and have several vertically spaced pairs of holes 58 defined therein. A pivot pin 60 inserted through the arm inner end tip 56 and one of the pairs of holes 58 so as to pivotally interconnect the arm 16 to the support member 14 defines the pivotal axis A of the arm which extends in the general direction of the flight of the football when kicked from its teed up position.

The configuration and weight distribution of the elongated arm 16 (which depends on the location of the tension adjustment means 20) with respect to its pivotal axis A are such that, upon upward movement through a short distance, it will overcenter the axis and quickly move out of the way of the follow-through motion of the kicker's foot. The arm 16 includes a generally straight body portion 62 which merges into a curved end portion 64 so as to define an overall, generally J-shaped configuration. When the arm 16 is extending in its generally horizontal football holding position, as seen in FIGS. 1 and 2, the curved end portion 64 which constitutes the inner end 52 of the arm 16 extends outwardly from one side of the pivotal axis A away from the teed up football F, whereas the straight body portion 62 which contains the outer end 54 of the arm 16 overlies the curved end portion and extends over and outwardly from the opposite side of the pivotal axis A toward the teed up football.

The flexible finger 18 of the practice holder 10 is connected to outer end 54 of the arm 16 and disposable into contact with an upper end of the football F for maintaining it in its teed up position, whereas the tension adjustment means 20 in the form of a cylindrical weighted body 20 is movably disposed on arm 16 between the inner and outer ends 52, 54 thereof for adjusting the tension imposed on the teed up football by the finger 18. While the base 12, support member 14, arm 16 and weighted body 20 are preferably constructed from metal material, the flexible finger 18 is preferably made from rubber, plastic or other suitable resiliently deformable material. The finger 18 is placed into contact with the upper end of the football by pivotally moving the arm 16 relative to the support member 14 from the one inoperative rest position, shown in dashed line form in FIG. 3, downwardly toward the football F after the football has been placed in the teed up position.

The weighted body 20 is disposed on a threaded section 66 on the arm 16. The threaded section 66 is defined between inner and outer ends 52, 54 of the arm and also located between the support member 14 and the football F when the arm has been moved downwardly toward the football and the finger 18 has been brought into contact with the football so as to maintain it in its teed up position and the arm in its generally horizontal holding position. Specifically, the weighted body 20, preferably composed of an internally threaded steel inner nut and an outer lead sleeve fitted over the inner nut, is threaded on the threaded section 66 of the arm 16. The body 20 is moved along the section 66 of the arm 16 by manually rotating it to a desired position in which it will exert the desired amount of pressure or tension on the football via the arm and finger. For instance, rotation of the body 20 in one direction produces movement thereof toward the support member 14 which, in turn, decreases the tension applied by finger 18 on the football F, whereas rotation of body 20 in an opposite direction produces movement thereof toward the football which, in turn, increases the tension applied by the finger on the football. The flexible tubular finger 18 can be sized to fit over the outer tip of the outer arm end 54 and be retained by the threads thereon. Alternatively, any other suitable way of connecting the finger 18 on the arm 16 can be utilized.

Because of the general position of the weighted body 20 on the arm 16 along with the J-shaped configuration of the arm 16 and its above-described pivotal connection to the support member 14, upon the football F being kicked from its teed up position the arm 16 and finger 18 can quickly pivotally move from their generally horizontal holding position to either of two possible inoperative rest positions. In the one of the rest positions, seen in solid line form in FIG. 3, the arm 16 and finger 18 assume a generally lowered inclination adjacent the inside of the support member 14 due to the force of gravity and due to the football being kicked without the kicking foot contacting the finger. In the other of the rest positions, seen in dashed line form in FIG. 3, the arm 16 and finger 18 assume a generally raised inclination upon their displacement by the force of the kicker's foot due to the foot contacting the finger.

It is thought that the football place-kicking practice holder of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed is:

1. A football place-kicking practice holder, comprising:

(a) a base adapted to rest on a playing surface and generally define a location for placing a football in a teed up position;

(b) a support member mounted in an upright position on said base such that said member is spaced from a side of a football when the football is disposed in the teed up position;

(c) an elongated arm being pivotally mounted to said support member for movement downwardly toward, and upwardly away from, a football in the teed up position and about an axis extending in the general direction of the flight of the football when kicked from the teed up position;

(d) a flexible finger connected to said arm and disposable into contact with an upper end of a football for maintaining it in the teed up position when said arm is moved relative to said support member downwardly toward the football after the football has been placed in the teed up position; and (e) a weighted body disposed on said arm for movement therealong between a football and said support member to adjust the tension imposed on the teed up football by said finger.

2. The place-kicking practice holder as recited in claim 1, wherein said support member has a generally straight configuration which allows sufficient space between said member and football being maintained in the teed up position by said finger for accommodating the follow-through motion of the kicking foot of a straight-style place-kicker past said support member.

3. The place-kicking practice holder as recited in claim 1, wherein said support member has a generally bowed configuration which allows sufficient space between said member and football being maintained in the teed up position by said finger for accommodating the follow-through motion of the kicking foot of a soccer-style place-kicker past said support member.

4. A football place-kicking practice holder, comprising:

(a) a base adapted to rest on a playing surface and generally define a location for placing a football in a teed up position;

(b) a support member mounted in an upright position on said base such that said member is spaced from a side of a football when the football is disposed in the teed up position;

(c) an elongated arm being pivotally mounted to said support member for movement downwardly toward, and upwardly away from, a football in the teed up position and about an axis extending in the general direction of the flight of the football when kicked from the teed up position;

(d) a flexible finger connected to said arm and disposable into contact with an upper end of a football for maintaining it in the teed up position when said arm is moved relative to said support member downwardly toward the football after the football has been placed in the teed up position; and (e) means disposed on said arm for movement therealong between a football and said support member to adjust the tension imposed on the teed up football by said finger;

(f) said elongated arm having a thread section for adjusting said tension adjusting means which is located between said support member and a football when said arm has been moved downardly toward the football and said finger has been brought into contact with the football so as to maintain it in the teed up position.

5. The place-kicking practice holder as recited in claim 4, wherein said tension-adjusting means is a weighted body threaded on said section of said arm for movement therealong by rotation of said body, whereby rotation of said body in one direction produces movement of said body toward said support member which decreases the tension applied by said finger on a football whereas rotation of said weighted body in an opposite direction produces movement of said body toward the football which increases the tension applied by said finger on the football.

6. The place-kicking practice holder as recited in claim 1, wherein said base and said support member include cooperable means for releasably connecting said support member to said base such that the position of said support member can be adjusted on said base along the general direction of flight of football when kicked from the teed up position and thereby the position of said arm and finger can be adjusted relative to the football for varying the angle of the football in the teed up position.

7. The place-kicking practice holder as recited in claim 1, wherein said base includes means for mounting a kicking tee so as to define said location on said base for placing a football in the teed up position.

8. The place-kicking practice holder as recited in claim 7, wherein said kicking tee mounting means is in the form of a generally flat platform.

9. The place-kicking practice holder as recited in claim 1, wherein said arm is movable, upon a football being kicked from the teed up position, from a generally horizontal football holding position to either of two possible inoperative rest positions, said arm and finger in one of said said rest positions assuming a lowered inclination due to the force of gravity and due to the football being kicked without the kicking foot contacting said finger, whereas said arm and finger in the other of said rest positions assuming a raised inclination upon their displacement by the force of the kicking foot due to the foot contacting said finger.

10. A football place-kicking practice holder, comprising:

(a) a base adapted to rest on a playing surface and generally define a location for placing a football in a teed up position;

(b) a support member having upper and lower ends, said member being interconnected at its lower end to, and mounted in an upright position on, said base such that said member is spaced from a side of a football when the football is disposed in the teed up position;

(c) an elongated arm having outer and inner ends, said arm being pivotally mounted at its inner end to said upper end of said support member for movement of said outer end of said arm downwardly toward, and upwardly away from, a football in the teed up position and in direction extending generally transverse to the general direction of flight of the football when kicking from the teed up position;

(d) a flexible finger connected to said outer end of said arm and disposable into contact with an upper end of a football for maintaining it in the teed up position when said arm is moved relative to said support member downwardly toward the football after the football has been placed in the teed up position; and (e) a weighted body disposed on said arm between said inner and outer ends thereof and being movable along said arm for adjusting the tension imposed on the teed up football by said finger.

11. The place-kicking practice holder as recited in claim 10, wherein said support member has a generally straight configuration which allows sufficient space between said member and a football being maintained in the teed up position by said finger for accommodating the follow-through motion of the kicking foot of a straight-style place-kicker past said support member.

12. The place-kicking practice holder as recited in claim 10, wherein said support member has a generally bowed configuration which allows sufficient space between said member and a football being maintained in the teed up position by said finger for accommodating the follow-through motion of the kicking foot of a soccer-style place-kicker past said support member.

13. A football place-kicking practice holder, comprising:

(a) a base adapted to rest on a playing surface and generally define a location for placing a football in a teed up position;

(b) a support member having upper and lower ends, said member being interconnected at its lower end to, and mounted in an upright position on, said base such that said member is spaced from a side of a football when the football is disposed in the teed up position;

(c) an elongated arm having outer and inner ends, said arm being pivotally mounted at its inner end to said upper end of said support member for movement of said outer end of said arm downwardly toward, and upwardly away from, a football in the teed up position and in a direction extending generally transverse to the general direction flight of the football when kicking from the teed up position;

(d) a flexible finger connected to said outer end of said arm and disposable into contact with an upper end of a football for maintaining it in the teed up position when said arm is moved relative to said support member downwardly toward the football after the football has been placed in the teed up position;

(e) means disposed on said arm between said inner and outer ends thereof for adjusting the tension imposed on the teed up football by said finger; and (f) said elongated arm having a threaded section which is located between said support member and a football when said arm has been moved downwardly toward the football and said finger has been brought into contact with the football so as to maintain it in the teed up position.

14. The place-kicking practice holder as recited in claim 13, wherein said tension-adjusting means is a weighted body threaded on said section of said arm for movement therealong by rotation of said body, whereby rotation of said body in one direction produces movement of said body toward said support member which decreases the tension applied by said finger on a football whereas rotation of said weighted body in an opposite direction produces movement of said body toward the football which increases the tension applied by said finger on the football.

15. A football place-kicking practice holder, comprising:

(a) a base adapted to rest on a playing surface and generally define a location for placing a football in a teed up position;

(b) a support member having upper and lower ends, said member being interconnected at its lower end to, and mounted in an upright position on, said base such that said member is spaced from a side of a football when the football is disposed in the teed up position;

(c) an elongated arm having outer and inner ends, said arm being pivotally mounted at its inner end to said upper end of said support member for movement of said outer end of said arm downwardly toward, and upwardly away from, a football in the teed up position and in a direction extending generally transverse to the general direction of flight of the football when kicking from the teed up position;

(d) a flexible finger connected to said outer end of said arm and disposable into contact with an upper end of a football for maintaining it in the teed up position when said arm is moved relative to said support member downwardly toward the football after the football has been placed in the teed up position;

(e) means disposed on said arm between said inner and outer ends thereof for adjusting the tension imposed on the teed up football said finger; and (f) said support member being formed by a pair of bars arranged in generally side-by-side fashion and connected together so as to define a space therebetween at said support member upper end for receiving and pivotally mounting said inner end of said arm.

16. The place-kicking practice holder as recited in claim 10, wherein said base and said support member at its lower end include cooperable means for releasably connecting said support member lower end to said base such that the position of said support member can be adjusted on said base along the general direction of flight of a football when kicked from the teed up position and thereby the position of said arm and finger can be adjusted relative to the football for varying the angle of the football in the teed up position.

17. The place-kicking practice holder as recited in claim 16, wherein said cooperable means includes:

a bracket fixed on said base and having an elongated slot defined therein which extends in the general direction of flight of a football; and at least one fastener attached on said lower end of said support member and extendible through said bracket slot for releasable connection of said support member at a desired position along said bracket.

18. A football place-kicking practice holder, comprising:

(a) a base adapted to rest on a playing surface and generally define a location for placing a football in a teed up position, said base including means for mounting a kicking tee so as to define said location on said base for placing the football in the teed up position;

(b) a support member having upper and lower ends, said member being interconnected at its lower end to, and mounted in an upright position on, said base such that said member is spaced from a side of a football when the football is disposed in the teed up position;

(c) an elongated arm having outer and inner ends, said arm being pivotally mounted at its inner end to said upper end of said support member for movement of said outer end of said arm downwardly toward, and upwardly away from, a football in the teed up position and in a direction extending generally transverse to the general direction of flight of the football when kicking from the teed up position;

(d) a flexible finger connected to said outer end of said arm and disposable into contact with an upper end of a football for maintaining it in the teed up position when said arm is moved relative to said support member downwardly toward the football after the football has been placed in the teed up position; and (e) means disposed on said arm between said inner and outer ends thereof for adjusting the tension imposed on the teed up football by said finger.

19. The place-kicking practice holder as recited in claim 18, wherein said kicking tee mounting means includes:

a generally flat platform; and a plurality of pins removably attached to said flat platform for receiving said kicking tee thereon and retaining it at said location on said base.

20. The place-kicking practice holder as recited in claim 10, wherein said arm being pivotally mounted to said upper end of said support member is defined by a generally straight body portion which merges into a curved end portion such that said portions have a generally J-shaped configuration, said curved end portion which constitutes said inner end of said arm extending away from a teed up football and said straight body portion which contains said outer end of said arm overlying and extending from said curved end portion toward the teed up football.

21. The place-kicking practice holder as recited in claim 10, wherein said arm is movable, upon a football being kicked from the teed up position, from a generally horizontal football holding position to either of two possible inoperative rest positions, said arm and finger in one of said rest positions assuming a lowered inclination due to the force of gravity and due to the football being kicked without the kicking foot contacting said finger, whereas said arm and finger in the other of said rest positions assuming a raised inclination upon their displacement by the force of the kicking foot due to the foot contacting said finger.

22. A football place-kicking practice holder, comprising:

(a) a base adapted to rest on a playing surface and having opposite lateral end portions;

(b) means disposed along one lateral end portion of said base adapted to support a football at its lower end in a teed up position;

(c) an elongated rigid support member having upper and lower ends;

(d) cooperable means fixed along the other lateral end portion of said base and attached to said lower end of said support member for mounting said member in an upright position on said base such that said support member is spaced from a side of a football when the football is disposed in the teed up position;

(e) an elongated rigid arm having outer and inner ends, said arm being pivotally mounted at its inner end to said upper end of said support member for movement of said outer end of said arm through an arcuate path downwardly toward, and upwardly away from, a football when in the teed up position and in a direction extending generally transverse to the general direction of flight of the football when kicked from the teed up position, said outer end of said arm having a threaded section thereon which is located between said support member and the football when said arm has been moved downwardly toward the football;

(f) a flexible hollow finger inserted on said outer end of said arm and disposable into contact with an upper end of a football for maintaining it in the teed up position when said arm is moved relative to said support member downwardly toward the football after the football has been placed in the teed up position; and (g) a weighted body threaded on said threaded section of said arm and being movable therealong by rotation of said body for adjusting the tension imposed on a teed up football by said finger, the rotation of said body in one direction producing movement of said body toward said support member which decreases the tension applied by said finger on the football whereas the rotation of said body in an opposite direction producing movement of said body toward the football which increases the tension applied by said finger on the football;

(h) said cooperable means being operable for adjusting the position of said elongated upright member on said base along the general direction of flight of a football when kicked from the teed up position and thereby adjusting the position of said arm and finger relative to the football for varying the angle of the football in the teed up position.

23. The place-kicking practice holder as rectied in claim 22, wherein said support member is formed by a pair of bars being arranged in generally side-by-side fashion and connected together so as to define a space therebetween at said support member upper end for receiving and pivotally mounting said inner end of said arm.

24. The place-kicking practice holder as recited in claim 22, wherein said cooperable means includes:

a bracket fixed on said base and having an elongated slot defined therein which extends in the general direction of flight of a football; and a pair of fasteners attached on said lower end of said upright member and extendible through said bracket slot for releasable connection of said support member at a desired position along said bracket.

25. The place-kicking practice holder as recited in claim 22, wherein said football supporting means is a kicking tee.

26. The place-kicking practice holder as recited in claim 22, wherein said arm being pivotally mounted to said upper end of said support member is defined by a generally straight body portion which merges into a curved end portion such that said portions have a generally J-shaped configuration, said curved end portion which constitutes said inner end of said arm extending away from a teed up football and said straight body portion which contains said outer end of said arm overlying and extending from said curved end portion toward the teed up football.

27. The place-kicking practice holder as recited in claim 22, wherein said arm is movable, upon a football being kicked from the teed up position, from a generally horizontal football holding position to either of two possible inoperative rest positions, said arm and finger in one of said rest positions assuming a lowered inclination due to the force of gravity and due to the football being kicked without the kicking foot contacting said finger, whereas said arm and finger in the other of said rest positions assuming a raised inclination upon their displacement by the force of the kicking foot due to the foot contacting said finger.

* * * * *

UNITED STATES PATENT AND TRADEMARK OFFICE

CERTIFICATE OF CORRECTION

PATENT NO. : 4,634,122

DATED : January 6, 1987

INVENTOR(S) : Roy A. Kline

It is certified that error appears in the above-identified patent and that said Letters Patent is hereby corrected as shown below:

Claim 2, Col. 7, line 27, insert --a-- before "football".
Claim 3, Col. 7, line 34, insert --a-- before "football".
Claim 4, Col. 7, line 64, change "thread" to --threaded--.
Claim 4, Col. 7, line 67, change "downardly" to --downwardly--.
Claim 6, Col. 8, line 19, insert --a-- before "football".
Claim 13, Col. 9, line 50, after "section" insert --for adjusting said tension adjusting means--.
Claim 15, Col. 10, line 28, after "football" insert --by--.
Claim 23, Col. 12, line 36, change "rectied" to --recited--.

Signed and Sealed this

Thirty-first Day of March, 1987

*Attest:*

DONALD J. QUIGG

*Attesting Officer*

*Commissioner of Patents and Trademarks*